US009144256B2

(12) United States Patent
Gheneva et al.

(10) Patent No.: US 9,144,256 B2
(45) Date of Patent: Sep. 29, 2015

(54) ARTICLE OF APPAREL FOR HOLDING AND OPERATING ELECTRONIC DEVICES

(75) Inventors: Dobriana D. Gheneva, Portland, OR (US); Edward Lang Boyd, Portland, OR (US); Peter M. Valles, Portland, OR (US)

(73) Assignee: Nike, Inc., Beaverton, OR (US)

( * ) Notice: Subject to any disclaimer, the term of this patent is extended or adjusted under 35 U.S.C. 154(b) by 1646 days.

(21) Appl. No.: 11/430,182

(22) Filed: May 9, 2006

(65) Prior Publication Data

US 2007/0261703 A1 Nov. 15, 2007

(51) Int. Cl.
*A41D 27/20* (2006.01)

(52) U.S. Cl.
CPC ..... *A41D 27/205* (2013.01)

(58) Field of Classification Search
CPC ..... A41D 27/20
USPC ..... 2/247, 917, 250–254, 16, 159, 160, 2/171, 308, 311; 224/929, 930, 219, 221, 224/222; D3/201, 215, 218, 269, 303
See application file for complete search history.

(56) References Cited

U.S. PATENT DOCUMENTS

| | | | | |
|---|---|---|---|---|
| 4,041,394 | A | | 8/1977 | Pate |
| 4,432,477 | A | | 2/1984 | Haidt et al. |
| 4,509,667 | A | | 4/1985 | Meldrum |
| 4,539,700 | A | | 9/1985 | Sato |
| 4,569,465 | A | | 2/1986 | O'Farrell |
| 4,875,238 | A | | 10/1989 | Solomon et al. |
| 4,876,724 | A | | 10/1989 | Suzuki |
| 4,901,355 | A | | 2/1990 | Moore |
| 4,913,326 | A | | 4/1990 | Echelson |
| 5,433,359 | A | | 7/1995 | Flowers |
| 5,454,185 | A | | 10/1995 | Love |
| 5,671,481 | A | * | 9/1997 | Giard ..... 2/170 |
| 6,062,700 | A | | 5/2000 | Price |
| 6,243,867 | B1 | | 6/2001 | Faison |
| 6,253,379 | B1 | | 7/2001 | Collier |
| 6,321,957 | B1 | | 11/2001 | Rossi |
| 6,324,053 | B1 | | 11/2001 | Kamijo |
| 6,561,814 | B2 | | 5/2003 | Tilbury et al. |
| 6,737,570 | B2 | | 5/2004 | Stevenson |
| 6,792,124 | B2 | | 9/2004 | Tilbury et al. |
| 6,826,782 | B2 | | 12/2004 | Jordan |

(Continued)

FOREIGN PATENT DOCUMENTS

| | | |
|---|---|---|
| AT | 008491 U1 | 9/2006 |
| DE | 20203813 | 6/2002 |

(Continued)

OTHER PUBLICATIONS

PCT/US2007/010633, International Search Report, dated Oct. 24, 2007.

(Continued)

*Primary Examiner* — Tejash Patel
(74) *Attorney, Agent, or Firm* — Banner & Witcoff, Ltd.

(57) ABSTRACT

An article of apparel comprising: a pocket, the pocket comprising an opening to permit insertion and removal of an electronic device, the pocket further comprising at least one raised portion, wherein when the electronic device is located in the pocket, at least one operational control button of the electronic device is positioned adjacent the at least one raised portion.

13 Claims, 5 Drawing Sheets

(56) References Cited

U.S. PATENT DOCUMENTS

| | | | | |
|---|---|---|---|---|
| 2002/0020045 | A1 | 2/2002 | Nasu et al. | |
| 2002/0100108 | A1 | 8/2002 | Stuart | |
| 2003/0144039 | A1 | 7/2003 | Lin | |
| 2003/0172432 | A1 | 9/2003 | Ishioka | |
| 2004/0133967 | A1 | 7/2004 | West | |
| 2004/0154076 | A1 | 8/2004 | Yoo | |
| 2005/0145657 | A1* | 7/2005 | Norberg | 224/222 |
| 2005/0184117 | A1 | 8/2005 | Brown | |
| 2005/0235398 | A1 | 10/2005 | Yoo | |
| 2005/0246823 | A1 | 11/2005 | Groom | |
| 2005/0279660 | A1 | 12/2005 | Deflin et al. | |
| 2006/0028430 | A1 | 2/2006 | Harary et al. | |
| 2006/0062413 | A1 | 3/2006 | Wehrell | |
| 2006/0075537 | A1 | 4/2006 | Tsai | |
| 2006/0206990 | A1 | 9/2006 | Demus | |
| 2006/0218690 | A1* | 10/2006 | James | 2/69 |
| 2007/0215663 | A1* | 9/2007 | Chongson et al. | 224/930 |

FOREIGN PATENT DOCUMENTS

| | | | |
|---|---|---|---|
| FR | WO03/068011 | * | 8/2003 |
| JP | 3007372 | | 11/1994 |
| JP | 10190797 | * | 7/1998 |
| JP | 11-192116 | | 7/1999 |
| JP | 3072205 | | 7/2000 |
| JP | 2002-194610 | | 7/2002 |
| JP | 2003-013317 | | 1/2003 |
| JP | 2004-041722 | | 2/2004 |
| JP | 2005-194671 | | 7/2005 |

OTHER PUBLICATIONS

Office Action issued on May 16, 2011 in corresponding Japanese Application No. 2009-509687.

Office Action issued on Jun. 13, 2011 in corresponding Japanese Application No. 2009-172591.

* cited by examiner

ARTICLE OF APPAREL FOR HOLDING AND OPERATING ELECTRONIC DEVICES

FIELD OF THE INVENTION

The present invention relates to apparel. Aspects of the invention concern, more particularly, an article of apparel that incorporates an electronic device that is hidden within the article of apparel yet operable from outside the article of apparel.

BACKGROUND OF THE INVENTION

The use of portable electronic devices, such as music players, is ever increasing. Such devices allow the listener to listen to audio recordings of, for example, music, news, and books, without disturbing others. Many listeners listen while walking, running, or working out in gyms. Others listen on airplanes or other forms of transportation to pass the time.

The portable electronic devices are often placed in a pocket of an article of apparel, for example, a shirt, or attached to an arm band. Typically the electronic device is removed from the pocket to operate the device and then returned when the device has been set. Alternatively, a hole or plastic window, for example, is provided to allow operation of the device.

When engaged in a physical activity, such as running, an athlete wants to maintain a focus on the activity. Removing an electronic device from a pocket to operate the device can be distracting to the athlete. In addition, the athlete may drop the device while fumbling to remove or replace the device from a pocket. Trying to operate the device through open holes or plastic windows in a pocket can also be distracting. Moreover, open holes expose the device to the elements and plastic windows advertise the presence of and type of electronic device.

BRIEF SUMMARY OF THE INVENTION

Aspects of the present invention include an article of apparel, such as an armband, wristband, shirt, or jacket that includes an electronic device. The article of apparel has a pocket having an opening to permit insertion and removal of an electronic device. The pocket has at least one raised portion. When an electronic device is located in the pocket, at least one operational control button of the electronic device is positioned adjacent the at least one raised portion.

BRIEF DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose various articles of apparel that incorporate an electronic device.

The article of apparel may be any suitable article of apparel that can be attached to the body such as, but not limited to, bands such as armbands, wristbands, leg bands, and belts. In addition, the article of apparel may be any suitable article of apparel that can be worn on the body such as shirts, jackets, coats, sweatshirts, vests, shorts, and pants, and various other articles of clothing.

The article of apparel has a pocket to hold an electronic device. An electronic device can be any suitable electronic device such as but not limited to portable musical devices including IPODs, portable MP3 players, portable CD players, portable radios, and portable tape players.

Figure 1:
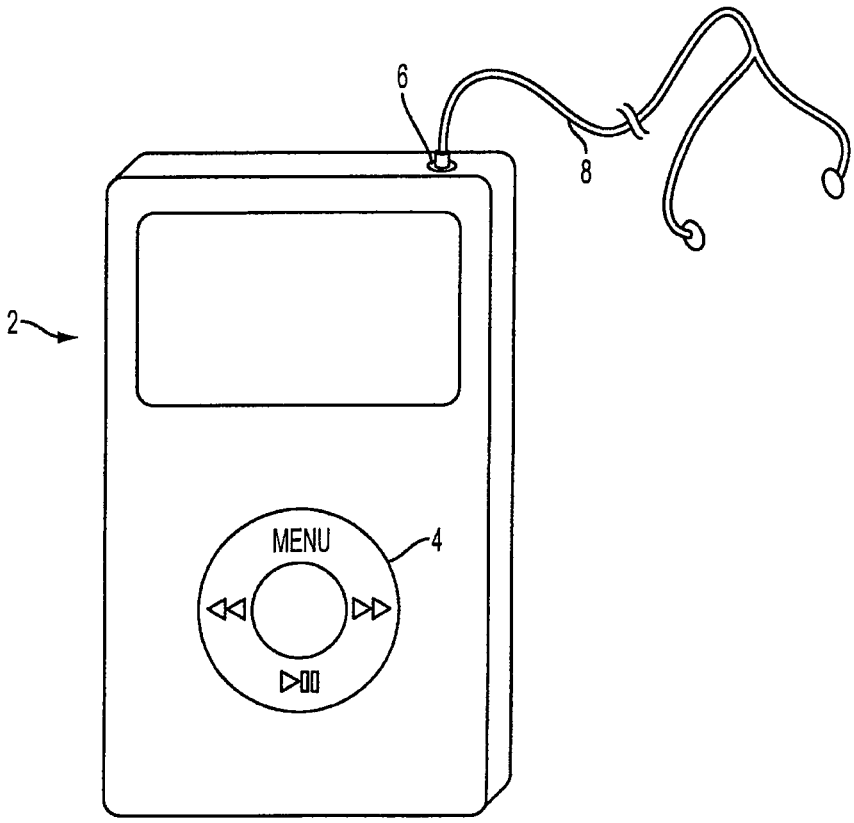
FIG. 1 is a perspective view of an electronic device that is suitable for use with an article of apparel in accordance with an aspect of the present invention.

The invention will be discussed in terms of an IPOD or IPOD-style electronic device such as generally shown in FIG. 1. The electronic device 2 has a circular operational button 4 wherein the operative selection choices are along the periphery of the operational button such as indicated by the notations "<<" (reverse), "||" (pause), and ">>" (forward). Ear phones 8 are connected to the electronic device via receiver 6.

Figure 2A:
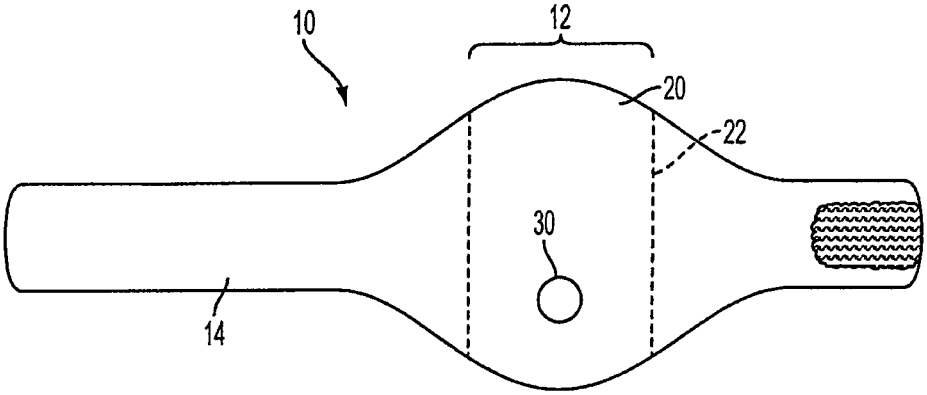
FIGS. 2A and 2B are a top view and a bottom view, respectively of an article of apparel in accordance with an aspect of the present invention.
Figure 2B:
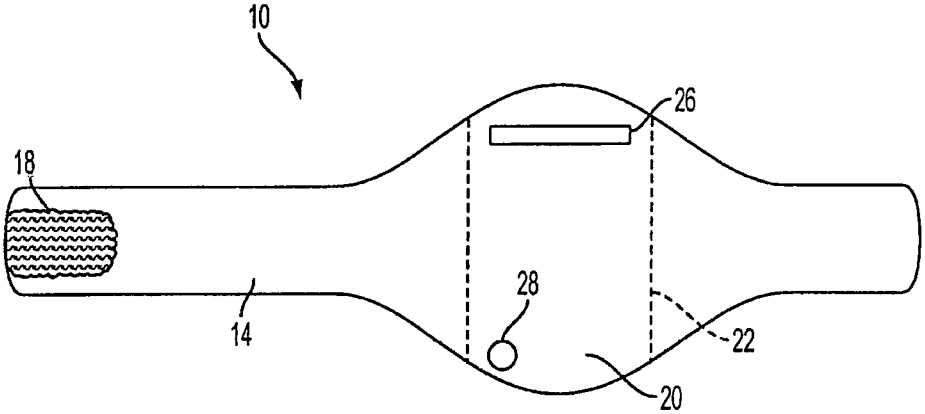

One aspect of the invention is shown in FIGS. 2A and 2B. An armband 10 is provided to be connected around the arm. The armband typically is a substantially flat strip of material having a central portion 12 and extensions 14 and 16 that wrap around the arm. The ends of extensions 14 and 16 have fasteners 18 to connect the ends together for attachment to the arm. Any suitable fasteners may be used such as Velcro, snaps, buttons, buckles, and zippers as is within the skill of the art. Velcro is depicted in FIGS. 2A and 2B and is generally an easy fastener to work with one hand.

A pocket 20 is located on the arm band 10 for carrying a portable electronic device. The pocket is configured to the size and shape of the electronic device, for example the electronic device shown in FIG. 1, so that when the device is placed in the pocket, the device does not shift significantly within the pocket.

An opening such as a slot is formed on the topside or under side of the arm band for insertion of the electronic device. FIG. 2B shows slot 26 on the under side of the arm band. The electronic device is placed into the pocket through the slot typically prior to locating the arm band 10 on the arm. The ear phones 8 can be connected to the electronic device through slot 26 or by a separate hole 28. The hole is positioned at the location of the receiver for the ear phones on the electronic device, either on the topside or under side of the pocket 20.

Figure 3A:
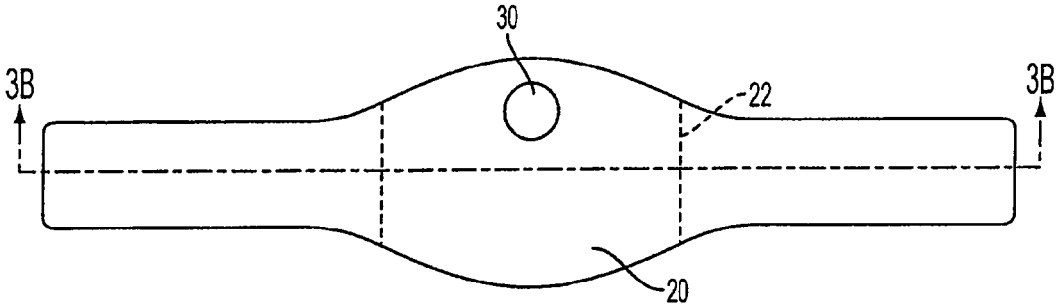
FIGS. 3A and 3B are a top view and internal side view of another article of apparel in accordance with an aspect of the present invention.
Figure 3B:
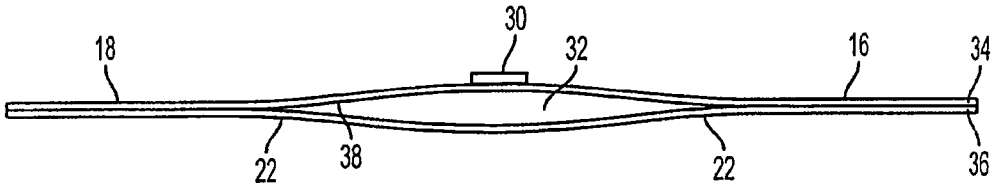

The pocket 20 may be a separate pocket attached to the arm band wherein the arm band forms the backside of the pocket (similar to a shirt pocket). Alternatively, the pocket may be formed integrally with the arm band. For example, as depicted in FIG. 3*b*, top layer 34 and bottom layer 36, each a substantially flat material having the desired shape of the arm band, are sewn or otherwise connected together. A space 32 is formed between the back layer and the front layer to form a pocket. The two layers may be attached to each other by sewing, gluing, or by heat sealing at least around the periphery of the arm band. The sides of the pocket are formed by sewing, gluing, or heat sealing the peripheral edge of the pocket to form side edges 22 of the pocket 20.

The top layer 34 and bottom layer 36 may be formed of the same material or different materials. For example, top layer 34 may be formed of a water-resistant material whereas bottom layer 36 may be formed of an absorbent material. The materials for both 34 and 36 can be breathable materials for additional comfort.

In addition, in the pocket regions of the materials, the pocket may be coated with a rubberized or other suitable material 38 to protect the electronic device from moisture, for example. If such a rubberized material is used, such material should not be used at the position of the operational button of the electronic device so as to not hinder operation of the button.

The pocket further contains a raised portion 30 positioned such that when the electronic device is inserted into the pocket, the raised portion is adjacent the active operational portions of the operational button of the electronic device. The raised portion guides the fingers of the operator to the position of the operational button and by simple pressing adjacent the raised portion, the operator may operate certain operations of the electronic device such as the forward, reverse, and pause operations.

Thus, for example, if the electronic device has a circular operational button 4 located near its center portion as shown in FIG. 1, wherein the selection choices are along the periphery of the operational button, then the article of apparel has a raised portion corresponding to the center of the circular operational button. During operation, a user would feel the pocket for the raised portion and operate the electronic device by pressing to the immediate right, left, top, or bottom of the raised portion.

The raised portion may be any suitable thickness and width. The thickness is sufficient for the operator to locate the raised portion but not too thick to encumber operation of the operational button. A suitable thickness is generally greater than about 1 mm and less than about 5 mm, e.g. about 2 mm to about 3 mm. The width of the raised portion is also sufficient for the operator to locate the raised portion but not too wide to encumber operation of the operational button. For example, the width can be about 5 to about 15 mm depending upon the operational button of the electronic device. For example, in the case of some IPODs, a width of about 9 to about 11 mm is suitable.

Thus, when the electronic device is placed inside the pocket, the device is essentially hidden by the pocket. However, the operator may still operate the device through the fabric of the pocket by feeling for the raised portion. The operator does not need to see the device to operate the device during movement such as running.

The raised portion may be made of any suitable material such as a soft or flexible polymer. The raised portion may be attached to the upper layer either above or below the material used for layer. Placing the raised portion below the material allows the button to be hidden by the fabric and allows a smooth, continuous top layer.

The raised portion may be any suitable shape depending on the operation button(s) of the electronic device. For example the shape may be circular, oval, square, rectangular, or triangular. In the case of an IPOD, the shape is circular. However, other electronic devices may provide operational buttons in other shapes such as square whereby the operating portions are located along the edges or at the corners of the square.

Although this aspect was discussed in terms of an arm band, the band may be of a suitable size and shape to fit a wrist, a leg, an ankle, or a waist.

Figure 4:
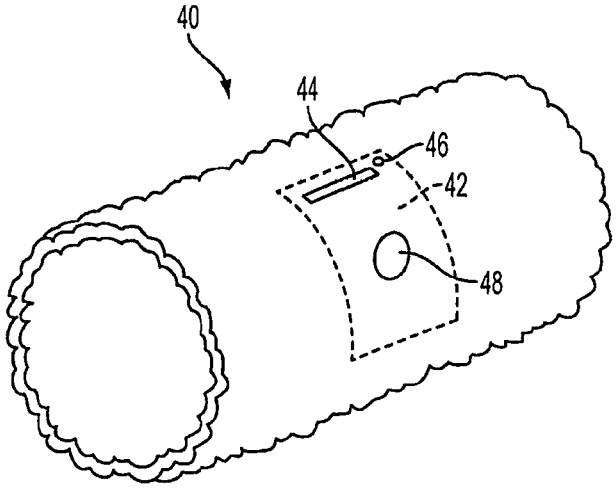
FIG. 4 is a perspective view of another article of apparel in accordance with an aspect of the present invention.

In another aspect of the invention, as shown in FIG. 4, a wrist band or armband may be a continuous tubular band 40 made of an elastic material that can be pulled onto the wrist or arm. Pocket 42 may be attached to, or formed integrally with, the band 40. The pocket has an opening or slit 44 for insertion of an electronic device, an optional hole 46 to accommodate the wire for the ear phones, and a raised portion 48 to direct an operator's fingers to the operational control button of the electronic device.

In further aspects of the invention, article of apparels to be worn by the user contain a pocket to hold an electronic device. The pocket may be formed integrally with or separately from the article of apparel. For example, a pocket may be sewn onto a shirt or jacket either on the front, back, or side of the article of apparel. The pocket may be sewn on three sides and the fourth side may be unattached to accommodate insertion and removal of the electronic device. A flap may be used to cover the top of the pocket if desired. Alternatively, all four sides of the pocket may be sewn and a separate opening (e.g. a slit) may be formed to accommodate the electronic device.

The pocket may be located in any suitable location on the article of apparel, generally in a region that is easily accessible by the user. The pocket is of a size and shape to snugly accommodate the electronic device, but loose enough to allow easy positioning and removal of the electronic device.

The pocket may be attached by stitching the pocket onto the article of apparel, or the pocket may be attached with VELCRO or a VELCRO-like material or with a zipper. VELCRO or a zipper allows the pocket to be removed if desired.

Figure 5:
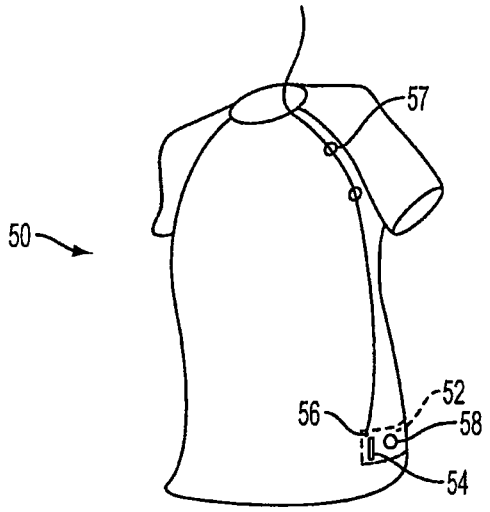
FIG. 5 is a perspective view of another article of apparel in accordance with an aspect of the present invention.

FIG. 5 depicts an article of apparel in the form of a shirt 50. In this aspect of the invention, a pocket 52 is located near the bottom of the shirt. The pocket 52 is attached to, or formed integrally with, the shirt 50. The pocket 52 has an opening or slit 54 for insertion of an electronic device, an optional hole 56 to accommodate the wire for the ear phones, and a raised portion 58 to direct an operator's fingers to the operational control button of the electronic device.

The shirt may have hooks or other suitable means 57 attached to the article of apparel to guide the wire from the electronic device to the ear phones. This prevents the wire from swinging or becoming tangled during physical activity such as running.

Figure 6:
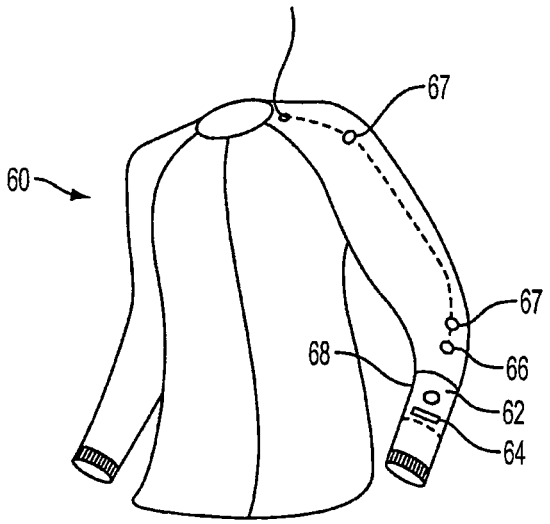
FIG. 6 is a perspective view of another article of apparel in accordance with an aspect of the present invention.

FIG. 6 depicts an article of apparel in the form of a long-sleeved jacket or coat 60. In this aspect of the invention, a pocket 62 is located near the bottom of the sleeve. The pocket 62 is attached to, or formed integrally with, the jacket or coat 60. The pocket 62 has an opening or slit 64 for insertion of an electronic device, an optional hole 66 to accommodate the wire for the ear phones, and a raised portion 68 to direct an operator's fingers to the operational control button of the electronic device.

The ear phone wire may travel from the electronic device inside the sleeve of the jacket and exit through a hole in the neck portion of the article of apparel. Alternatively, the article of apparel may have hooks 67 or other suitable connection means similar to those depicted in FIG. 5 such that the wire may travel along the outside of the arm from the electronic device to the ear phones. The hooks preventing the wire from swinging during physical activity such as running.

Figure 7:
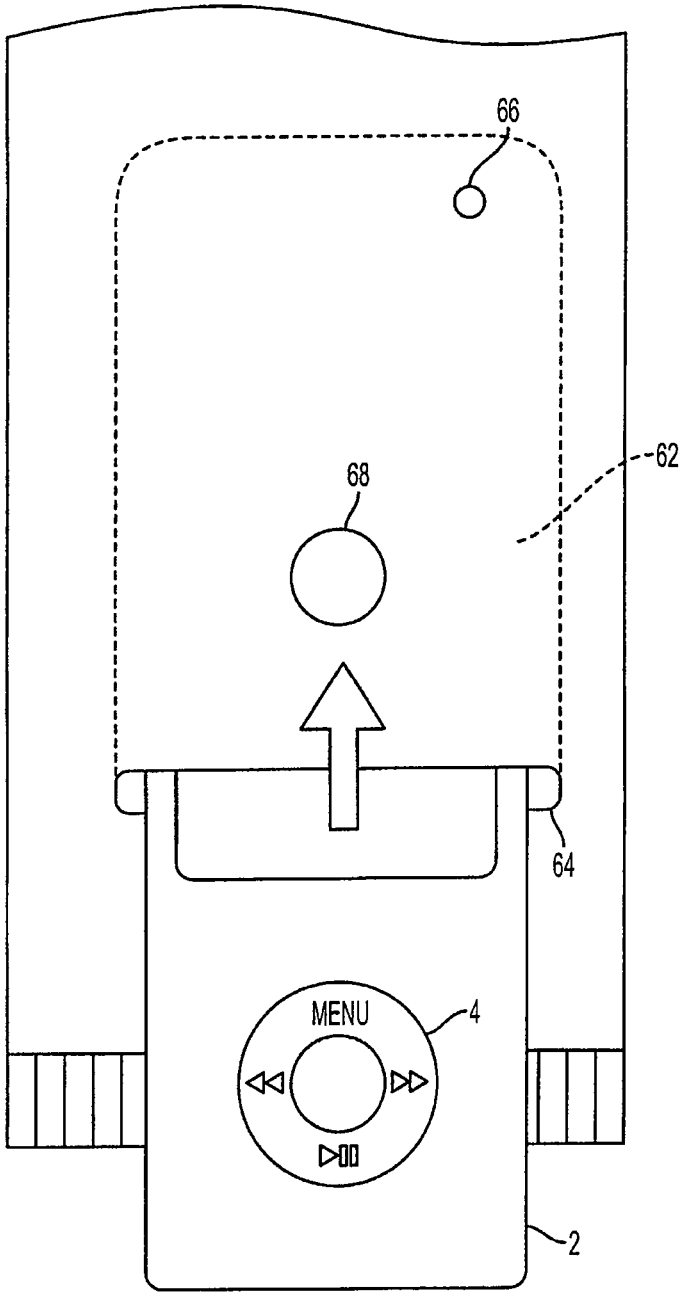
FIG. 7 is a top view of an electronic device being inserted into an article of apparel in accordance with an aspect of the present invention.

FIG. 7 depicts how to insert the electronic device 2 into slot 64 of article of apparel 60. The operational control button 4 is positioned underneath raised portion 68. After positioning the electronic device into place, the ear phone wire is plugged in through hole 66.

In general, the article of apparel is formed from a material element, such as a textile or polymer sheet. The article of apparel itself should be able to support the weight of the electronic device.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An arm band comprising:

a pair of extensions, at least one of the extensions of the pair of extensions housing a portion of a fastener;

a pocket internally formed in the arm band and configured to hold an electronic device having one operational control button comprising a circular ring having selection choices along the ring and to prevent shifting of a portable electronic device when the portable electronic device is placed within the pocket; and a protrusion housed on the pocket internally formed in the arm band, the protrusion being positioned and complimentary shaped and sized such that the operational control button of the portable electronic device circumscribes the protrusion and the protrusion covers the center of the circular ring when the portable electronic device is housed within the pocket.

2. The arm band of claim 1 wherein the protrusion has a thickness of at least about 1 mm.

3. The arm band of claim 2 wherein the protrusion has a thickness of at least about 1 mm and less than about 5 mm.

4. The arm band of claim 2 wherein the protrusion has a width of about 5 to about 15 mm.

5. The arm band of claim 1 wherein the pocket includes at least one aperture for routing a cord out of the pocket.

6. The arm band of claim 1 wherein the armband is attachable to a body appendage.

7. An arm band consisting essentially of:

a pair of extensions, at least one of the extensions of the pair of extensions housing a portion of a fastener;

a pocket internally formed in the arm band and configured to hold an electronic device having one operational control button comprising a circular ring having selection choices along the ring and to prevent shifting of a portable electronic device when the portable electronic device is placed within the pocket; and a protrusion housed on the pocket internally formed in the arm band, the protrusion being positioned and complimentary shaped and sized such that the operational control button of the portable electronic device circumscribes the protrusion and the protrusion covers the center of the circular ring when the portable electronic device is housed within the pocket.

8. An arm band comprising:

a pair of extensions, at least one of the extensions of the pair of extensions housing a portion of a fastener;

a pocket internally formed in the arm band and configured to hold an electronic device having an operation control button including reverse, pause, and forward selection choices and to prevent shifting of a portable electronic device when the portable electronic device is placed within the pocket; and a protrusion housed on the pocket internally formed in the arm band, the protrusion being positioned and complimentary shaped and sized such that the operational control button of the portable electronic device circumscribes the protrusion and the protrusion is positioned laterally adjacent to the reverse, pause, and forward selection choices of the operational control button when the portable electronic device is housed within the pocket.

9. The arm band of claim 8 wherein the protrusion has a thickness of at least about 1 mm.

10. The arm band of claim 9 wherein the protrusion has a thickness of at least about 1 mm and less than about 5 mm.

11. The arm band of claim 9 wherein the protrusion has a width of about 5 to about 15 mm.

12. The arm band of claim 7 wherein the pocket includes at least one aperture for routing a cord out of the pocket.

13. The arm band of claim 7 wherein the armband is attachable to a body appendage.

* * * * *